United States Patent [19]

Ferguson et al.

[11] Patent Number: 4,646,712

[45] Date of Patent: Mar. 3, 1987

[54] SOLID FUEL HEATING APPLIANCES

[75] Inventors: Robert W. Ferguson, So. Royalton; Derik K. Andors; William W. Crossman, Jr., both of Randolph, all of Vt.

[73] Assignee: Vermont Castings, Inc., Randolph, Vt.

[21] Appl. No.: 761,590

[22] PCT Filed: Nov. 21, 1984

[86] PCT No.: PCT/US84/01929

§ 371 Date: Jul. 29, 1985

§ 102(e) Date: Jul. 29, 1985

[87] PCT Pub. No.: WO85/02455

PCT Pub. Date: Jun. 6, 1985

Related U.S. Application Data

[63] Continuation-in-part of Ser. No. 555,511, Nov. 28, 1983, Pat. No. 4,510,918, and Ser. No. 572,000, Jan. 19, 1984, Pat. No. 4,582,044.

[51] Int. Cl.[4] ..... F24C 1/14

[52] U.S. Cl. ..... 126/79; 126/77; 126/112; 126/83; 110/211; 110/214; 110/203

[58] Field of Search ..... 126/79, 77, 83, 112, 126/117; 110/203, 210, 211, 213, 214; 126/15 R, 15 A, 146

[56] References Cited

U.S. PATENT DOCUMENTS

| | | | |
|---|---|---|---|
| 1,399,511 | 12/1921 | Moquist | 126/83 |
| 2,781,039 | 2/1957 | Kaiser et al. | 126/74 |
| 2,845,882 | 8/1958 | Bratton | 110/8 |
| 3,043,247 | 7/1962 | Hebert et al. | 110/211 |

List Continued on next page.

FOREIGN PATENT DOCUMENTS

| | | | |
|---|---|---|---|
| 21233 | 6/1961 | Austria | 110/203 |
| 0037281 | 10/1981 | European Pat. Off. . | |
| 0087259 | 6/1983 | European Pat. Off. . | |
| 2257072 | 6/1974 | Fed. Rep. of Germany . | |
| 1472591 | 5/1977 | United Kingdom . | |

OTHER PUBLICATIONS

"A Catalytic Converter You Can Build," *The Mother Earth News*, Jan.-Feb. 1983, pp. 163-165.

Riteway's Uni-Com Brochure, 1983.

Smokemaster brochure, Dorwood Industries Ltd.

Smoke Genie brochure, Arden Industries, Inc., 1983.

In-Ten'si-Fire Owner's Manual, Catalytic Damper Corporation.

Versagrid brochure, Applied Ceramics, Inc.

Hart Fireplace Furnishings brochure, Form No. 1200-A.

The Shelburne Catalytic brochure, The Vermont Stove Company.

*Primary Examiner*—Larry Jones

*Attorney, Agent, or Firm*—Wolf, Greenfield & Sacks

[57] ABSTRACT

Solid fuel heating appliance having high thermal efficiency and low levels of polluting emissions. The heating appliance includes an insulated secondary combustion chamber where a mixture of exhaust gases from the primary combustion chamber and secondary air is burned. A catalytic igniter is provided in the secondary combustion chamber to lower the ignition temperature of the unburned volatile gases from the primary combustion chamber. Regenerative feedback structure is provided in heat exchange relationship with the exhaust from the secondary combustion chamber to preheat the mixture entering the secondary combustion chamber, catalytic igniter, and the regenerative heat transfer assure substantially continuous combustion within the secondary combustion chamber even when conditions in the primary combustion chamber change. In a retrofit embodiment for existing stoves, a sheet metal partition in the secondary combustion chamber allows heat transfer from spent gases to the entering mixture of exhaust and secondary air. In a unitary stove embodiment, secondary air is heated by the spent gases which proceed to remote heat exchangers separated from the primary firebox by ventilated air spaces. To prevent room emissions, the stove door is sealed by a vented double gasket system.

29 Claims, 12 Drawing Figures

U.S. PATENT DOCUMENTS

| | | | |
|---|---|---|---|
| 3,056,467 | 10/1962 | Ravich | 23/277 |
| 3,880,594 | 4/1975 | Shaw | 23/277 C |
| 4,027,602 | 6/1977 | Mott | 110/203 X |
| 4,039,292 | 8/1977 | Morini et al. | 23/288 FC |
| 4,054,411 | 10/1977 | Beck | 432/242 |
| 4,138,220 | 2/1979 | Davies et al. | 422/173 |
| 4,249,509 | 2/1981 | Syme | 126/77 |
| 4,279,629 | 7/1981 | Simms | 55/307 |
| 4,291,669 | 9/1981 | Herne, Jr. | 126/83 |
| 4,319,556 | 3/1982 | Schwartz et al. | 126/77 |
| 4,330,503 | 5/1982 | Allaire et al. | 422/177 |
| 4,332,206 | 6/1982 | Tucker et al. | 110/203 |
| 4,345,528 | 8/1982 | Allaire et al. | 110/203 |
| 4,363,785 | 12/1982 | Willson | 422/173 |
| 4,373,507 | 2/1983 | Schwartz et al. | 126/289 |
| 4,380,228 | 4/1983 | Crowley | 126/76 |
| 4,385,568 | 5/1983 | Murray | 110/211 X |
| 4,400,356 | 8/1983 | McVay et al. | 422/171 |
| 4,422,437 | 12/1983 | Hirschey | 126/77 |
| 4,425,305 | 1/1984 | Retallick | 422/180 |
| 4,426,992 | 1/1984 | Martenson | 126/77 |
| 4,437,451 | 3/1984 | Wysong | 126/77 |
| 4,466,358 | 8/1984 | Christian | 110/211 |
| 4,466,421 | 8/1984 | Dorsch et al. | 126/285 A |
| 4,476,852 | 10/1984 | Lee et al. | 126/289 |
| 4,484,530 | 11/1984 | Goetzman | 110/211 X |
| 4,502,395 | 3/1985 | Barnett | 110/214 |

SOLID FUEL HEATING APPLIANCES

BACKGROUND OF THE INVENTION

This application is a continuation-in-part of U.S. Ser. No. 555,511, filed on Nov. 28, 1983, now U.S. Pat. No. 4,510,918, issued Apr. 16, 1985, and U.S. Ser. No. 572,000, filed on Jan. 19, 1984, now U.S. Pat. No. 4,582,044, issued Apr. 15, 1986.

This invention relates to solid fuel heating appliances and more particularly to such appliances having high heating efficiency while generating low levels of polluting emissions.

As wood burns in a modern, air tight woodburning stove, products of both complete and incomplete combustion are created containing polluting emissions including particulate material and unburned volatiles which are discharged into the atmosphere and heavier compounds such as creosote which can condense onto the inside surface of the chimney flue. The problem is exacerbated when burning at low heat levels in an oxygen-starved mode. Creosote build up is dangerous in that it can ignite causing a hazardous chimney fire. The particulate emissions are damaging to the environment. Not only do the unburned volatiles have a detrimental impact on the environment, but also the heating value of these unburned volatiles is wasted as the volatiles are discharged into the atmosphere.

In an effort to make a cleaner burning stove with higher thermal efficiency, manufacturers have made stoves employing various techniques for more complete combustion such as secondary combustion chambers and catalytic combustors. Known catalytic combustors usually include a thick, perforate honeycomb structure of ceramic or other material coated with a catalyst material such as platinum, palladium or rhodium. The surface properties of these catalyst materials are such that the combustion products, too cool to burn unaided, will burn within the catalytic combustor. The conventionally known catalytically equipped stoves are so designed that virtually all of the combustion occurring beyond the primary firebox volume occurs within the volume of the catalytic element itself. Combustion ceases downstream of the catalytic element primarily because the region beyond the catalytic element is typically made of a heat conductive material allowing heat to escape thereby quenching further combustion. Since combustion in known stoves with catalytic combustors takes place entirely within the volume of the combustor, these combusters are quite thick. If combustion is not complete by the time the gases have exited the combustor, it is unlikely that any additional combustion will occur. Hence, the thicker, the better was the prevailing rule. However, even though the combustor is perforated, its thickness constitutes a significant flow restriction which increases back pressure.

Solid fuel stoves are also know which employ a secondary combustion chamber for further burning of gases from the primary combustion chamber. Generally, however, woodburning stoves with secondary combustion chambers, even if they are capable of sustaining combustion prior to a log shift, may "wink out" during the exhaust gas composition change due to a shift in the fuel load, for example, by a falling log. Even if the exhaust gases return to the same composition shortly after the distrubing event, the secondary system may not re-ignite if it has cooled down sufficiently in the meantime. In order to maintain secondary combustion and a clean burn in a stove with a conventional secondary combustion chamber, the combination of sensible heat (the temperature of the gases before they enter the secondary chamber) and latent heat (the heat released when the combustible constituents are burned in the secondary) contained in the gas mixture must be high enough to maintain continuous temperatures in the secondary chamber above 1000°-1200° F. If the gas mixture changes temporarily such that the total amount of heat (sensible and latent) available to the secondary chamber is insufficient to maintain the proper chamber temperatures, secondary combustion will cease. The gases will not re-ignite no matter how rich until they are again brought up to a temperature of 1000°-1200° F. when entering the secondary chamber. In general, reignition requires operator attention similar to that required during the initial lighting of the secondary chamber. Operation of a stove with a secondary combustion chamber with the secondary combustion extinguished is to be avoided since creosote and other emissions are worse than with a conventional wood stove having no secondary chamber.

A further problem of conventional secondary combustion chambers involves heat transfer to the primary chamber. While heat transfer to the room is desired for thermal efficiency, secondary heat can undesirably influence primary combustion. If too much heat from secondary combustion is fed back to the primary combustion chamber, the result can be uncontrolled devolatization. This interaction interferes with the ability to control primary combustion solely by adjusting the primary air.

In an effort to make cleaner burning solid fuel stoves, manufacturers have introduced retrofit units for existing stoves including catalytic combustors intended to reduce the levels of smoke and creosote and increase efficiency. Generally, the operation of known retrofit units is unpredictable at best, depending upon the base appliance to which it is attached. This marginal situation is the result of the retrofit catalytic combustor being located too far from the wood stove firebox, resulting in exhaust gases entering the catalyst at a temperature too low for optimum catalyst performance, especially when the stove is operated at lower heat output levels. During low heat output operation with known systems, the gases exiting the stove body are often at too low a temperature for sustained catalytic ignition. In such a situation, the catalytic combustor will have little, if any, effect on the levels of undesirable effluents. Furthermore, because known catalytic elements are on the order of three inches thick, their use results in elevated back pressures thereby diminishing draft and resulting in less efficient operation.

A further problem with highly efficient woodburning stoves is their increased tendency toward leakage of light hydrocarbons through the gasketing material. The unavailablity of better sealing asbestos gasketing makes the problem even worse.

It is therefore an object of this invention to provide solid fuel heating apparatus having high thermal efficiency and low levels of polluting emissions.

Yet another object of the invention is a solid fuel heating appliance in which secondary combustion is maintained during periods of exhaust gas composition fluctuations.

Yet another object of the invention is an exterior retrofit system for attachment to existing woodburning stoves for reducing harmful emissions and improving combustion efficiency.

SUMMARY OF THE INVENTION

The applicants herein have discovered that the combination of three elements, igniter means, preferably catalytic, insulated secondary combustion chamber and regenerative heat feedback, results in a solid fuel heating appliance in which the secondary combustion chamber sustains combustion during and after composition and temperature changes in the exhaust gases from the primary combustion chamber due to shifts in the solid fuel load, such as the falling of a log when wood is the fuel source. The solid fuel heating appliance disclosed herein includes an insulated secondary combustion chamber, preferably insulated by means of refractory materials. Preferably, a thin catalytic igniter element is placed at the entrance to the secondary combustion chamber. The catalytic element serves to lower ignition temperature of the primary exhaust gases to as low as 600° F. A mixture of the primary exhaust gases and secondary air exceeding this temperature and passing through the catalytic igniter will be ignited and will continue to burn in the insulated secondary combustion chamber since the heat of secondary combustion is conserved in the insulated secondary chamber. Because secondary combustion occurs throughout the secondary combustion chamber rather than merely within the confines of the catalytic element itself, more complete combustion is achieved for higher thermal output efficiency and lower emissions. Moreover, the thickness of the catalytic element is significantly reduced.

One more element is required to insure sustained combustion within the secondary chamber. During low heat output operation of a wood stove, either by design or as a result of a shift in the fuel supply, the exhaust gases exiting the stove body are often too low, in the range of 350°-500° F., for catalytic ignition by the catalytic igniter. Applicants have overcome this shortcoming by utilizing in a regenerative fashion the heat released in the secondary combustion chamber for preheating the mixture of secondary air and primary exhaust gases before they reach the catalytic igniter to a level at which the gases will ignite and burn in the secondary combustion chamber. The applicants herein have combined the elements of catalytic igniter, insulated secondary combustion chamber, and a preheating of the gases entering the igniter to produce both a free-standing unitary stove and a retrofit appliance resulting in higher thermal efficiencies and lower harmful effluents.

In addition to the above-mentioned aspects of this invention, in one embodiment of the invention, a unitary stove, the crossfire primary combustion system is arranged to force the combustible gases formed during devolatilization of the wood to pass through the charcoal portion of the fuel bed just prior to exiting the primary chamber. This final preconditioning of the exhaust combustibles is important for two reasons. First of all, the gases are elevated in temperature even at low fuel comsumption rates because the charcoal bed becomes extremely hot as it consumes any excess oxygen left in the primary gases. Secondly, removing or stripping the excess oxygen from the primary gases removes the oxygen level variable from the system. Thus, the ability to meter the proper amount of secondary air into the combustible gases arises when the combustible gases are consistently oxygen depleted rather than containing variable levels of oxygen. A secondary air metering device is added in one embodiment to take advantage of this property. Ideally, an air shutter is controlled as a function of the combustion temperature in the secondary combustion region.

In this unitary stove embodiment of the present invention, the solid fuel heating apparatus includes a primary combustion chamber for burning a supply of solid fuel such as wood contained therein and a secondary combustion chamber in gaseous communication with the primary combustion chamber. The secondary combustion chamber is lined with a refractory insulating material and includes a perforate catalytic igniter through which combustion gases from the primary combustion chamber flow. The secondary combustion chamber further includes insulating refractory baffles arranged to enhance mixing of the combustion gases and located to re-radiate heat onto the catalytic igniter. Manifolds are provided for introducing secondary combustion air into the secondary combustion chamber so that the combustion gases are more completely burned to improve heating efficiency and to reduce harmful emissions. The tortuous path through the secondary combustion chamber caused by the refractory baffles helps insure more complete combustion because of longer residence time within the secondary combustion chamber.

In this unitary stove embodiment the combustion gas/secondary air mixture is preheated to insure ignition by the catalytic igniter. Preheating is accomplished by placing the secondary combustion air manifolds in heat exchange relation with the combustion gases after they have passed through the catalytic igniter and have burned in the secondary combustion chamber. The catalytic igniter has a thickness and perforate open area to minimize a pressure drop across the igniter for improved draft of the heating apparatus. Not only do the final exhaust gases preheat the gas/air mixture before entering the secondary combustion chamber, but the exhaust gases also serve to improve the delivery of heat into a room through side heat exchangers separated from the primary and secondary combustion chambers by convective ventilated air spaces. These side heat exchangers include circuitous passageways to enhance the heat exchange surface area. The separation of the side heat exchangers from the primary fuel firebox (magazine) by ventilated air space is important to the performance of the stove. While heat must be transferred away from the final exhaust gases to obtain high levels of thermal performance, the heat from the final exhaust gases must be kept from elevating temperatures in the primary firebox which would cause uncontrollable devolatilization of the fuel. The applicants have discovered that having a side heat exchanger sharing a common wall with the primary firebox would often cause this uncontrolled devolatilization process which interfered with the ability to control primary combustion by controlling primary air. Separating the heat exchanger from the primary firebox with a convective air space enhances controlled devolatilization and also enhances heat transfer to the room.

Stoves which rely on the devolatilization (gasification) of wood in a primary combustion zone with subsequent combustion of the volatile gases in a secondary combustion zone often suffer from odor problems due to even minute quantities of noxious gases escaping the devolatilization chamber. In another aspect of the invention in a unitary stove having a removable section, such as a loading door, a double gasket system provides for a tight inner seal similar to that in a conventional single gasket system to prevent migration of most of the gases outwardly from the primary combustion chamber. However, regardless of the integrity of the seal, small amounts of gases will find their way past. The present invention solves this problem by adding a second gasket to form a passageway between the two gaskets. This passage is ventilated with a small amount of fresh room air and is in direct communication with the final exhaust exit. In this way, the small quantities of noxious compounds residing in the space between the gaskets are carried up the exhaust stack along with the small amounts of fresh room air and thus never find their way into the room to cause odor problems.

Another embodiment of the invention is a self-contained retrofit unit including the combination of a catalyic igniter and an insulated secondary combustion chamber and further including means for preheating gases entering the secondary combustion chamber utilizing heat generated through combustion in the secondary combustion chamber. The retrofit combustion system for attachment to a solid fuel heating appliance as disclosed herein includes a firebox attached to the solid fuel heating appliance in communication with the flue gases from the heating appliance. The firebox includes refractory lined walls separated by a heat exchange barrier creating first and second passageways. A perforate catalytic igniter located at the lower end of the heat exchange barrier allows communication between the first and second passageways. The refractory lined walls create a secondary combustion chamber for burning the effluents from the stove body thereby resulting in a cleaner burning operation. In this embodiment it is preferred that the heat exchange barrier have a zig zag configuration and be made of stainless steel. It is also preferred that the refractory lined walls have an undulating configuration to increase residence time and mixing within the secondary combustion chamber for more complete burning. Secondary air is introduced into the retrofit unit both before and after the catalytic igniter to insure an adequate supply of oxygen for complete combustion. The heat from combustion in the secondary combustion chamber beyond the igniter is transferred through the heat exchange barrier to heat the gas/secondary air mixture on the other side of the barrier. In this way, secondary combustion is maintained for highly efficient, clean burning.

BRIEF DESCRIPTION OF THE DRAWING

The invention disclosed herein will be understood better with reference to the drawing of which.

DESCRIPTION OF THE PREFERRED EMBODIMENT

Figure 1:
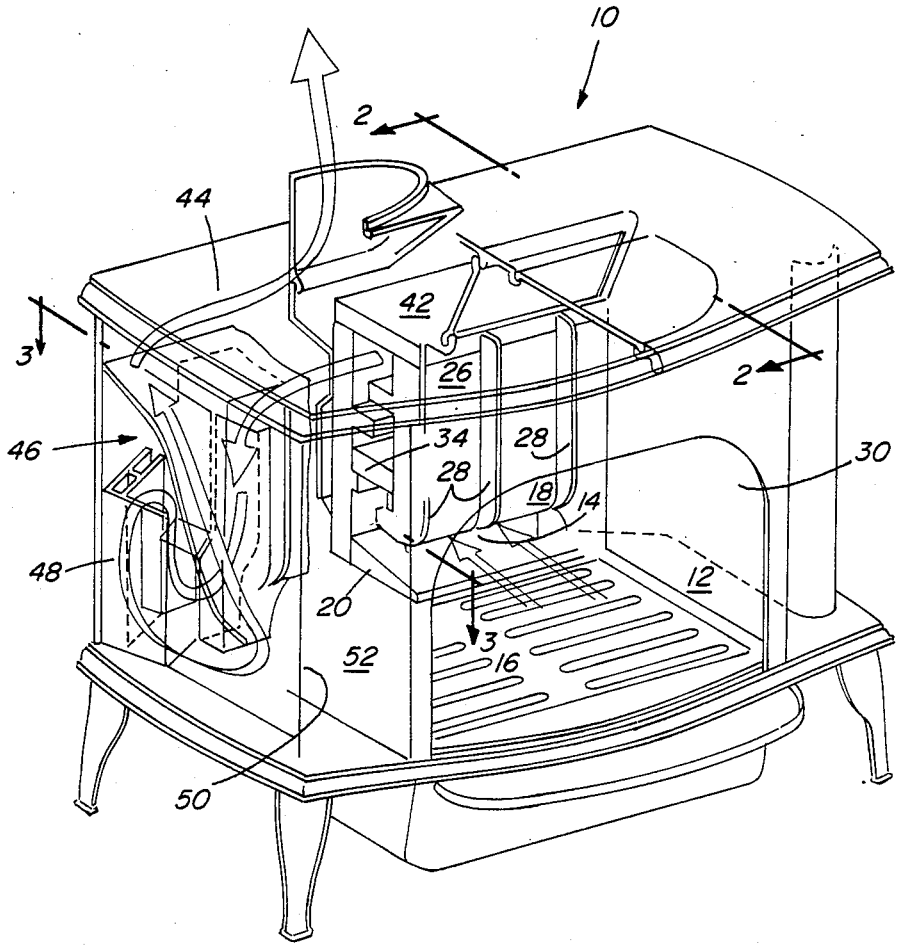
FIG. 1 is a perspective view, partially cut away, of a free-standing solid fuel heating appliance disclosed herein.
Figure 2:
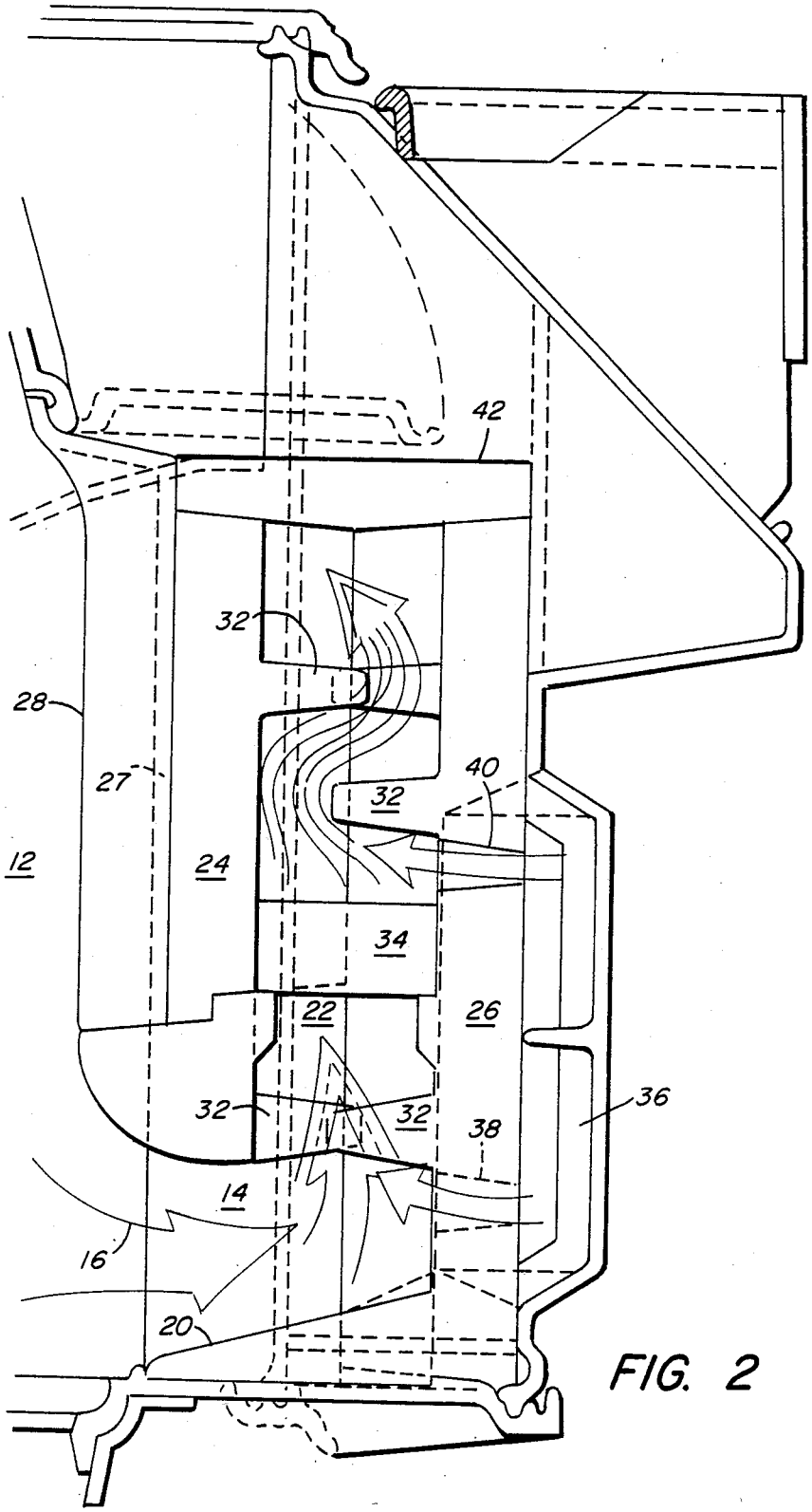
FIG. 2 is a cross-sectional side view taken along section lines 2—2 of FIG. 1.

A free-standing version of applicants' invention incorporating the features discussed above is shown in FIGS. 1–7. With reference first to FIGS. 1 and 2, a solid fuel heating apparatus 10 includes a primary combustion chamber 12 suitable for holding wood (not shown) for burning. Other solid fuels such as coal may also be utilized. As solid fuel burns in the primary combustion chamber 12, the combustion gases flow through a passageway 14 in the direction shown by arrows 16. The passageway 14 is created by an arch 18 and a ramp 20, both made of an insulating refractory material. The incline of the ramp 20 aids in turning the gas flow upwardly and also helps prevent ash build-up thereon. As best shown in FIGS. 2 and 4, the passageway 14 leads to a secondary combustion chamber 22 created by a front refractory member 24 and a rear refractory member 26. The front refractory member 24 is located adjacent to a metal fireback 27 which faces into the primary combustion chamber 12. The fireback 27 and the refractory arch 18 include ribe 28 which project into the primary combustion chamber 12 to maintain an appropriate air space behind the wood in the primary combustion chamber 12.

Figure 5:
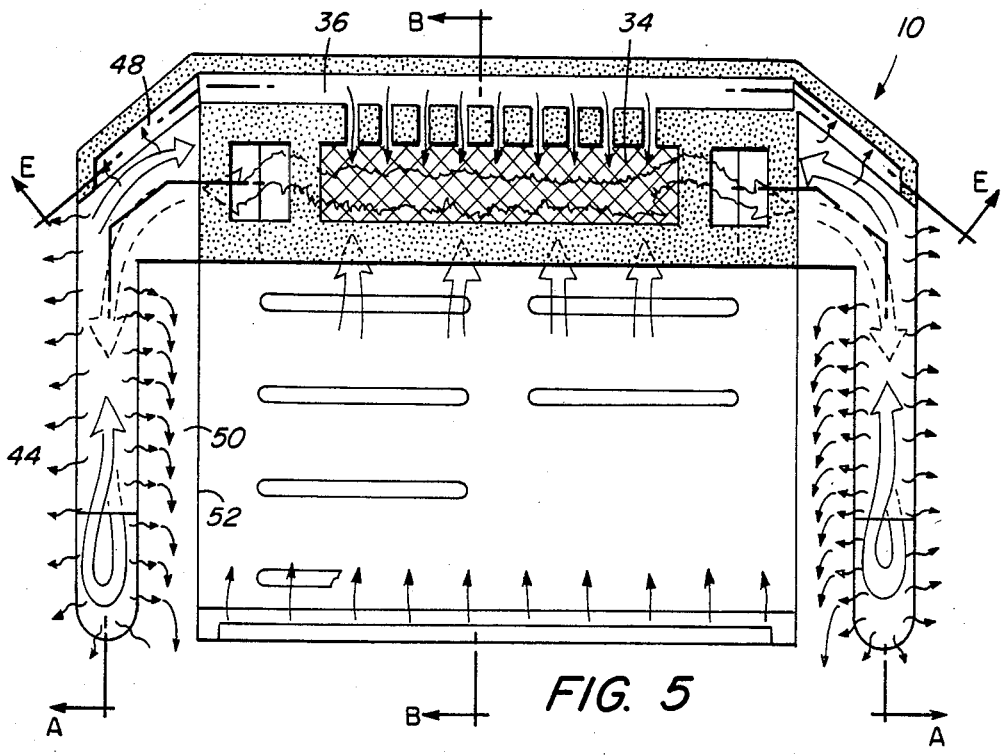
FIG. 5 is a top cross-sectional view of the stove of FIG. 4.
Figure 6:
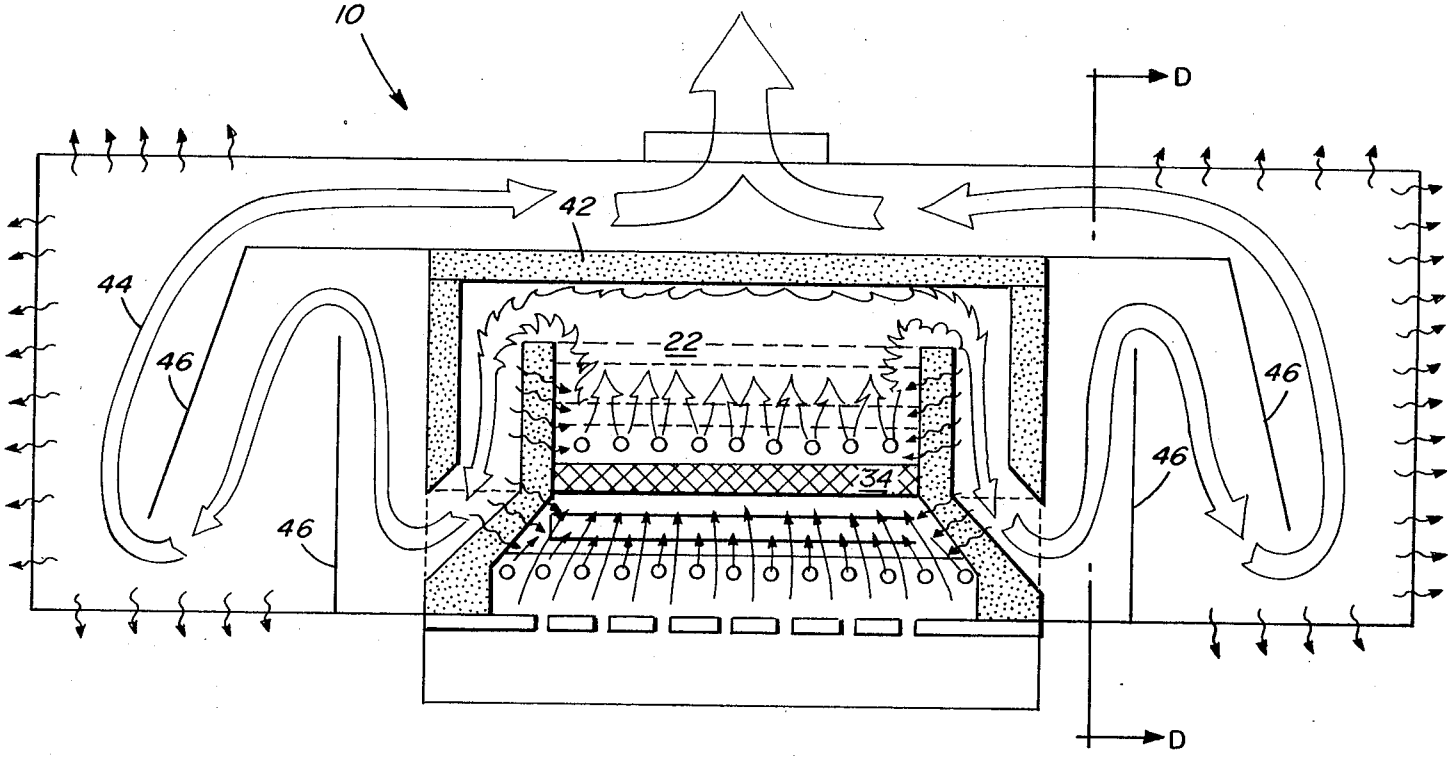
FIG. 6 is a cross-sectional view along the lines A—A of FIG. 5.

The front and back refractory members 24 and 26 are preferably vacu-formed/fired low density refractory materials. As can be seen in FIG. 2, the members 24 and 26 include integrally formed baffles 32 which extend into the secondary combustion chamber 22. The members 24 and 26 are also adapted to support a catalytic igniter 34. As can be seen in FIGS. 1, 5 and 6, the catalytic igniter 34 is a rectangular honeycomb structure made of a ceramic or metal coated with a catalyst material such as platinum, palladium or rhodium. In the present embodiment, the catalytic igniter 34 has dimensions of approximately 2½ inches deep, 12 inches long and 1 inch thick. To facilitate combustion in the secondary combustion chamber 22, secondary combustion air from a secondary air manifold 36 enters the secondary combustion chamber 22 through a lower row of openings 38 and an upper row of openings 40, FIG. 7. The manifold 36 is well insulated to maintain the secondary combustion air in a preheated condition as will be discussed herein below.

Figure 7:
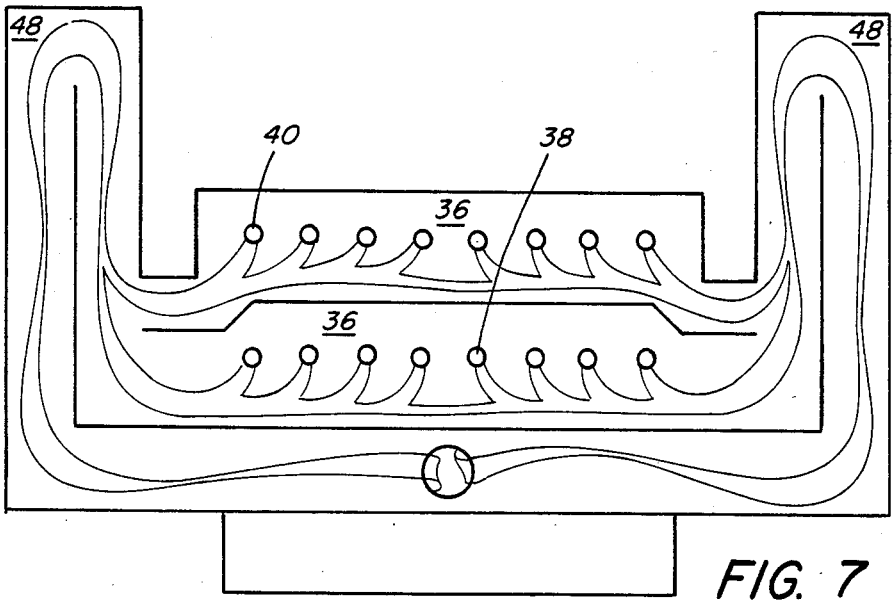
FIG. 7 is a cross-sectional view along section lines E—E of FIG. 5.

The introduction of both primary and secondary combustion air will now be discussed. With reference first to FIG. 4, primary air enters the apparatus 10 through primary air inlet 31 into a primary manifold 33 through which primary combustion air passes into the primary combustion chamber 12. Secondary combustion air enters the apparatus 10 through a secondary inlet 35 entring a secondary manifold 37. With reference to FIGS. 1, 5 and 7, secondary air entering at the secondary inlet 35 travels outwardly in the manifold 37 and upwardly through secondary heat exchanger passages 48. From there the secondary air travels downwardly and then through the holes 38 and 40 into the secondary combustion chamber 22. As will be described below, the heat exchanger passages 48 are washed on their outer surfaces by the final exhaust gases from the apparatus 10. In this way, the secondary combustion air is preheated before it enters the secondary combustion chamber 22. With reference now to FIGS. 1, 2 and 6, the top of the secondary combustion chamber 22 is closed by a top refractory member 42 which forces the gases from the secondary combustion chamber toward the sides of the heating apparatus 10 and down along the outer surfaces of the secondary combustion chamber. The flow along these surfaces helps maintain a high temperature in the second combustion chamber. As shown in FIGS. 1, 5 and 6, the gases from the secondary combustion chamber 22 are caused to follow a circuitous path (shown by the arrow 44) by metal barriers 46. As can be seen most clearly in FIGS. 1 and 5, final exhaust gases from the secondary combustion chamber 22 traveling along the arrow 44 wash past the secondary air heat exchanger 48. As shown in FIG. 7, after passing through the heat exchanger passages 48, the then preheated secondary combustion air passes through holes 38 and 40 into the secondary combustion chamber 22. Thus, outside air is drawn into the secondary manifold 37 through inlet 35 and passes through the heat exchanger 48 where it is preheated by the action of the exhaust gases traveling along the arrow 44 and then enters the manifold 36 for delivery to the secondary combustion chamber.

Figure 3:
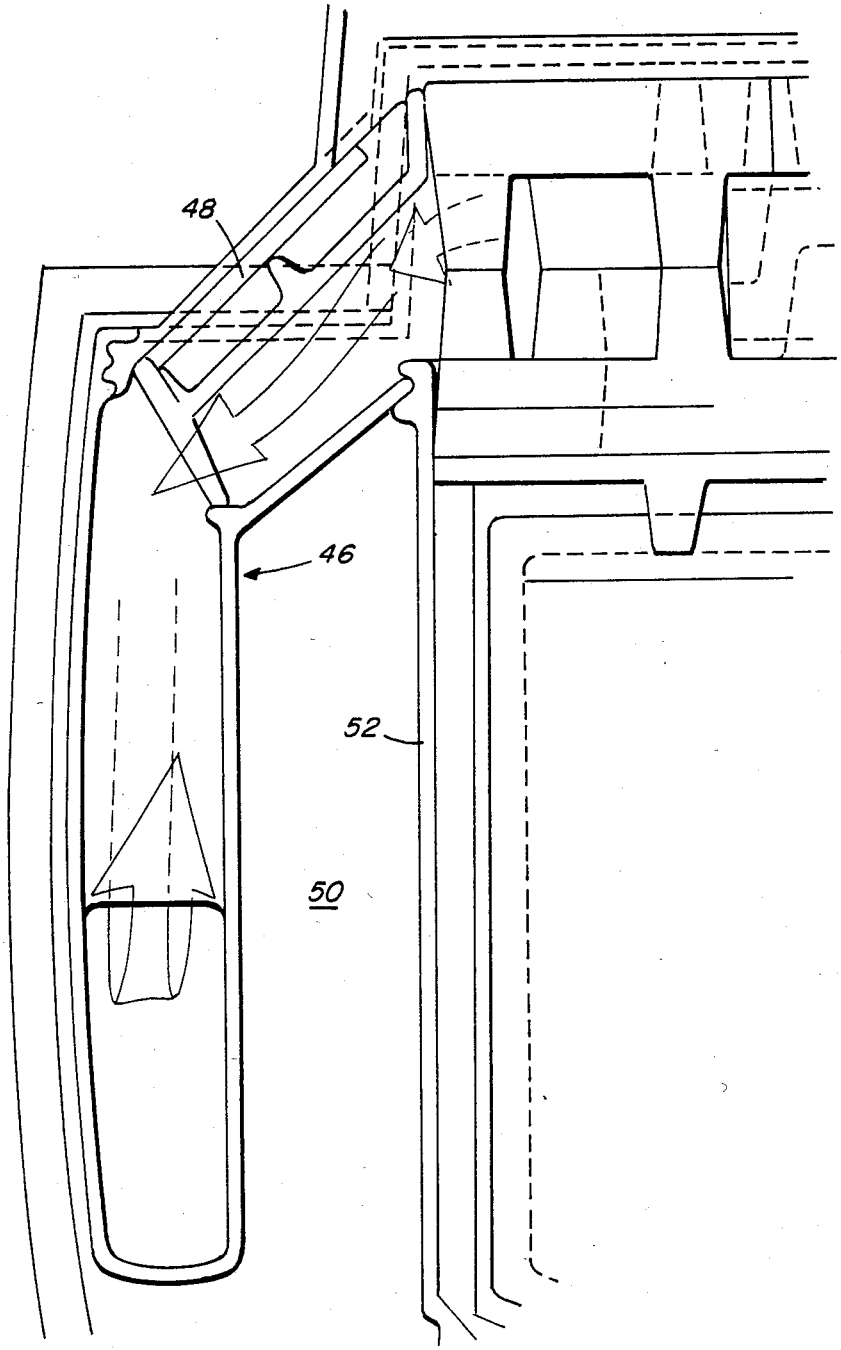
FIG. 3 is a top cross-sectional view along section lines 3—3 of FIG. 1.
Figure 4:
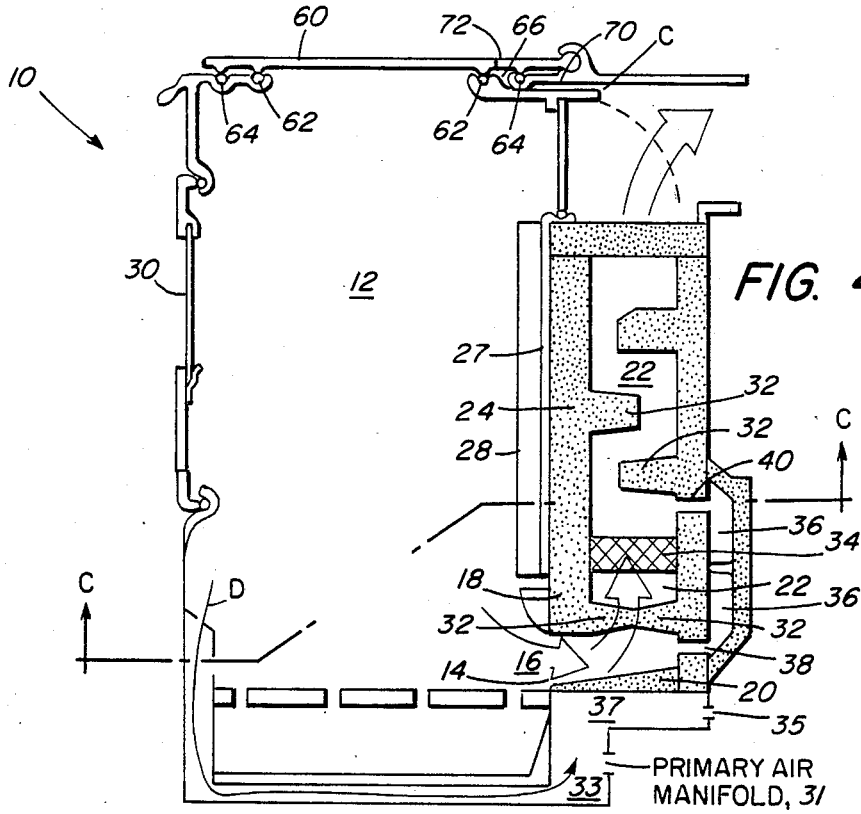
FIG. 4 is a cross-sectional view of the stove of FIG. 1.

With reference now to FIGS. 1, 3 and 5, there is shown a convective air space 50 which separates the heat exchange and exhaust pathways from the main stove body 52. Thus, the final exhaust gases passing along the arrow 44 not only transfer heat to the secondary air within the secondary air heat exchanger 48, but also cause heat to be transferred to air in the convective air space 50 for delivery into a room to be heated. By separating the heat exchange section from the primary combustion chamber, the primary combustion chamber is prevented from becomming overheated which would cause uncontrolled devolatilization of the combustion gases.

Another aspect of the present invention will now be discussed with reference to FIG. 4. The top of the primary combustion chamber 12 is closed by means of a top or griddle 60. The top 60 seals the primary combustion chamber 12 by means of inner and outer gaskets 62 and 64. A passageway 66 is created between the gaskets 62 and 64. The passageway 66 is in direct communication with the final exhaust exit 68 by means of a conduit 70. A small opening 72 is provided to allow fresh air to enter the passageway 66. Because of flowing gases in the exhaust exit 68, any noxious gases and a small quantity of fresh room air will be drawn through the conduit 70 thereby preventing noxious gases from seeping through the outer gasket 64 into a room.

The operation of the heating apparatus 10 will now be discussed with reference to FIGS. 1–7. As wood or other solid fuels are burned in the primary combustion chamber 12, combustion gases are forced to flow through the passageway 14 into the secondary combustion chamber 22. It should be noted that the passageway 14 is at the lower portion of the primary combustion chamber 12 and, in particular, is in the region where a charcoal bed will be formed. Thus, the combustible gases in the primary combustion chamber 12 formed during devolatilization of the wood pass through the charcoal bed portion of the fuel bed just prior to exiting into the secondary combustion chamber 22. As discussed above, this final preconditioning of the exhaust combustibles both elevates the temperature of the combustibles and removes excess oxygen from the primary exhaust gases. The baffles 32 create turbulence to enhance mixing of the combustion gases with secondary combustion air entering the secondary combustion chamber 22 through the openings 38 and 40 in the refractory member 26. The mixture of combustion gases and secondary air proceeds through the perforate catalytic igniter 34. The catalytic igniter 34 has the property of reducing the temperature at which the combustion gases/secondary air combination will ignite to aproximately 600° F. Thus, as the combustion gas/secondary air combination passes through the catalytic igniter 34, combustion is initiated and continues in the refractory lines secondary combustion chamber 22. The heat of combustion combined with the insulating property of the refractory members 24 and 26 combine to maintain a high temperature in the secondary combustion chamber 22. Not only do the baffles 32 enhance mixing by causing turbulence, they also are located to re-radiate heat back onto the catalytic igniter 34 to enhance its performance. As discussed above, the exhaust gases follow a circuitous, heat transferring path both for transferring heat into the room by means of the convective air space 50 and also for preheating the secondary combustion air.

Figure 8:
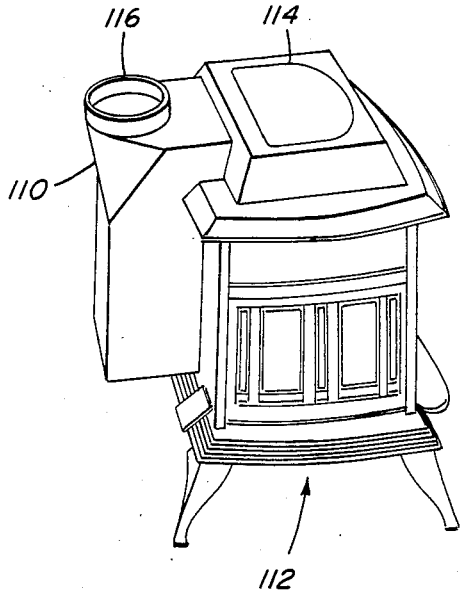
FIG. 8 is a perspective view of the retrofit apparatus disclosed herein attached to a solid fuel heating appliance.

The features of the present invention—namely, the combination of a catalytic igniter/insulated secondary combustion chamber along with regenerative preheating—have also been embodied in a self-contained retrofit unit adapted for connection to existing solid fuel burning stoves. With reference now to FIG. 8, an external retrofit apparatus 110 is shown affixed to a solid fuel heating applicance 112, such as a Vigilant® Wood Stove manufactured by Vermont Castings, Inc. The exterior retrofit apparatus 110 includes an attachment portion 114 which is adapted to be bolted directly onto the stove 112 in place of the stove's original flue collar (not shown). A flue collar 116 is then bolted onto the exterior retrofit apparatus 110. The height of the flue collar 116 remains the same as it had been on the wood stove 112 and horizontal and vertical flue position options are retained. In general, the only modifications necessary for the installation of the retrofit unit 110 is repositioning the stove 112 forward approximately 6 inches. The retrofit unit 110 is approximately 14 inches wide, 6½ inches deep and 18 inches high. It is preferred that the external components of the unit 110 be made of cast iron or cast iron in combination with sheet metal or aluminum. The retrofit unit 110 will now be described in detail with reference to FIG. 9. The retrofit unit 110 is attached to the woodburning stove 112 so that exhaust gases from the stove 112 enter the exterior retrofit apparatus 110 as indicated by an arrow 120. The retrofit apparatus 110 is divided front to back by a stainless steel heat exchanger 122 forming a first passageway 124 and a second passageway 126. As shown, the heat exchanger 122 has a zig-zag or undulating shape to increase surface area for better heat exchange. The walls of the retrofit apparatus 110 are lined with refractory material 128 which also has an undulating shape to increase the effective combustion chamber length and therefore to increase the residence time of the gases. The refractory material 128 is preferably vacuum-formed, insulating refractory material. The undulating shape of the refractory material 128 also improves mixing for more efficient operation. Openings 129 are provided to allow secondary air to enter the retrofit unit 110 both before and after a catalytic igniter 130. The catalytic igniter 130 is disposed in the lower portion of the retrofit apparatus 110. The catalytic igniter 130 is made of a honeycomb ceramic substrate coated with a catalyst such as platinum. Other catalysts and substrates may also be appropriate. The catalytic igniter 130 is approximately 1 inch thick. The relative thinness of the catalytic igniter 130 minimizes the pressure drop across the igniter 130.

The operation of the retrofit apparatus 110 will now be discussed. Products of combustion from the wood stove 112 enter the retrofit apparatus 110 along the arrow 120 and flow downwardly through the first passageway 124 and subsequently through the perforate catalytic igniter 130 into the passageway 126. As the gases pass through the catalytic igniter 130, they are ignited and burn further in the secondary combustion area indicated by the bracket 132. Secondary combustion air enters the unit 110 through the openings 129 to provide an adequate supply of oxygen for complete combustion. The catalytic igniter 130 is an igniter with a substantial portion of the combustion occurring outside the confines of the catalytic igniter 130 itself. The products of the secondary combustion travel upwardly through the passageway 126 and exit through a flue collar 134. As the gases travel upwardly in the passageway 126, they pass across the heat exchanger 122 transferring heat into the passageway 124 since gases in the passageway 126 are substantially hotter than those in the first passageway 124 which have not yet been secondarily burned.

The internal heat exchange capability of the apparatus 110 is an important aspect of this invention. For example, during low heat output operation of the appliance 112, exhaust gases exiting from the appliance 112 are often in the temperature range of 350°-500° F. which may be too low for catalytic ignition by the catalytic igniter 130. By mean of heat transfer through the heat exchange panel 122 the gases are preheated to a temperature of 500°-650° F. or higher which is sufficient for sustaining catalytic ignition and subsequent secondary combustion in the retrofit apparatus 110. Also, a cleaner burn will result at higher heat outputs even when the temperature of the gases entering the catalytic igniter is already high enough for catalytic ignition. By always transferring sensible heat to the gas stream entering the catalytic igniter/insulated secondary combustion chamber from the relatively hotter final exhaust, the highest possible temperatures are maintained in the secondary combustion area 132 for more nearly complete burning of the gases. A result of the use of the retrofit apparatus 110 is higher stack temperatures at low heat output than would be the case with a typical non-catalytic stove burning at a comparable pound per hour rate of fuel consumption. The resulting higher stack temperatures of the retrofit apparatus 110 at low heat output can help prevent creosote condensation within the stove pipe or chimney and also improve low draft problems in installations having marginal draft and/or during warm weather.

Figure 9:
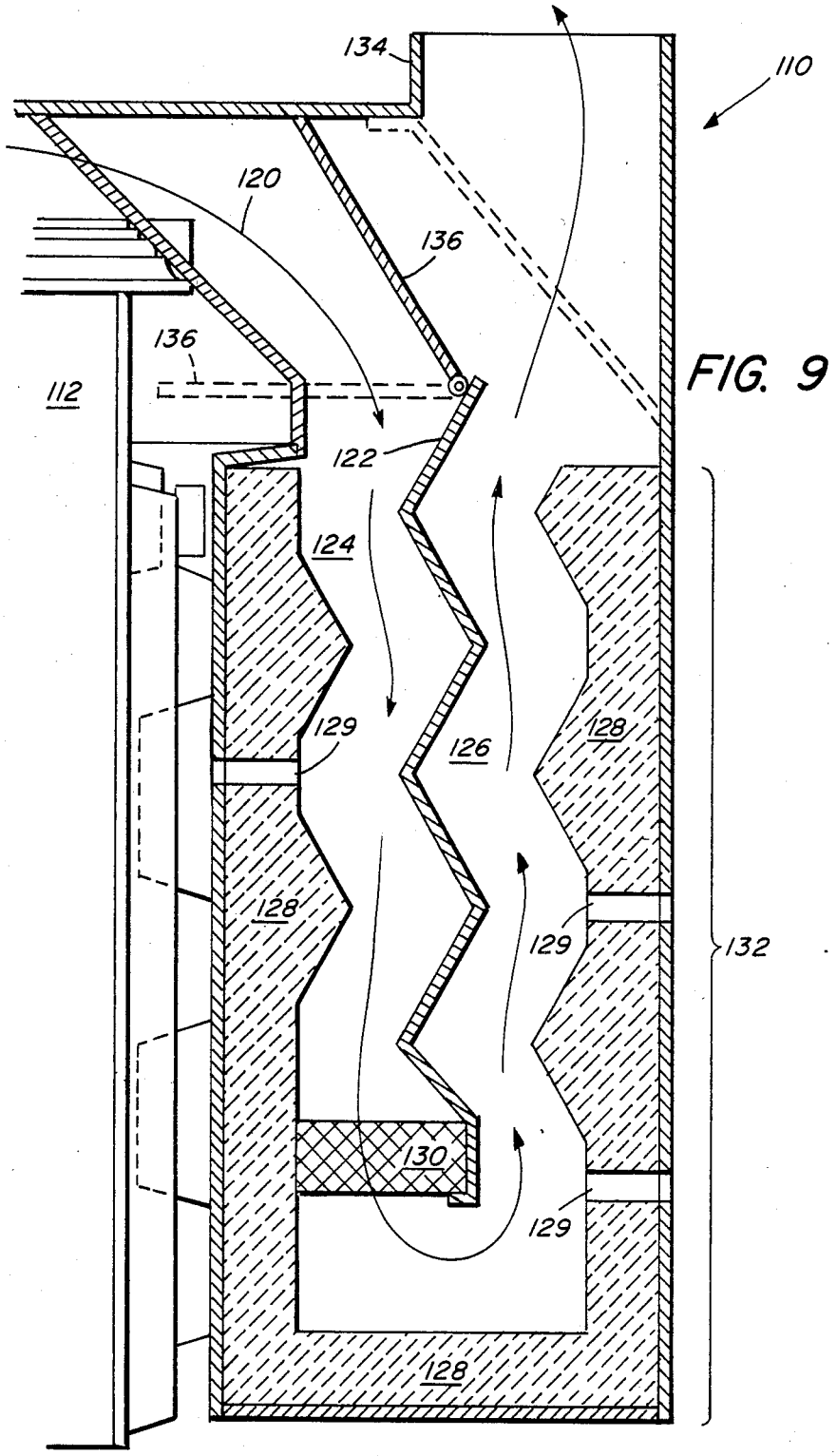
FIG. 9 is a cross-sectional view of the retrofit apparatus of FIG. 8.

Still referring to FIG. 9, a damper 136 is provided which is integral with the retrofit apparatus 110 and which directs gases down through the passageway 124 when it is in the position illustrated in FIG. 9 and directly through the flue collar 134 when it is lowered into the position shown in phantom. The lowered position is utilized during loading of wood into the heating appliance 112 or during start up.

The above-described retrofit apparatus 110 is designed for clean operation in the heat output range of from 20,000-50,000 BTU's per hour or approximately 4-10 pounds of wood per hour. Within this range, there should be a significant reduction in smoke and creosote emitted from the flue. The combination of the refractory lined secondary combustion chamber and catalytic igniter along with regenerative preheating results in continued secondary combustion even if ideal conditions are not maintained. Thus, even if heat output drops, secondary combustion will continue without any operator attention. This characteristic is important because stoves are often operated for long periods of time without any attention. The insulated refractory lined secondary chamber provides the gases with the residence time at elevated temperatures necessary for more complete combustion.

The performance of both the unitary stove and retrofit embodiments is further enhanced by the addition of a secondary air control device.

Figure 10:
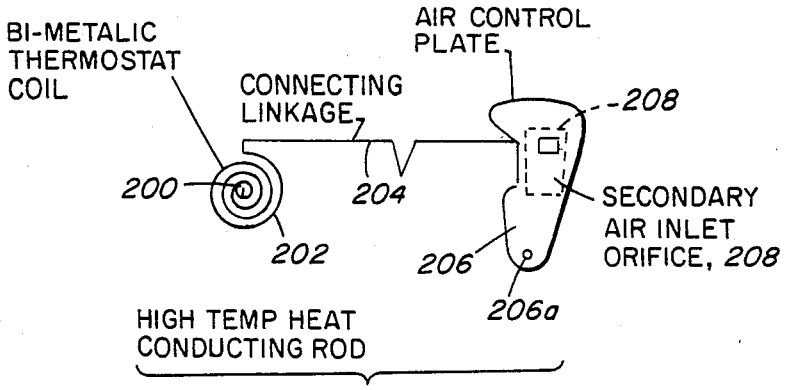
FIG. 10 is a schematic plan view of the secondary air control components showing the bimetallic coil and air control plate.
Figure 11:
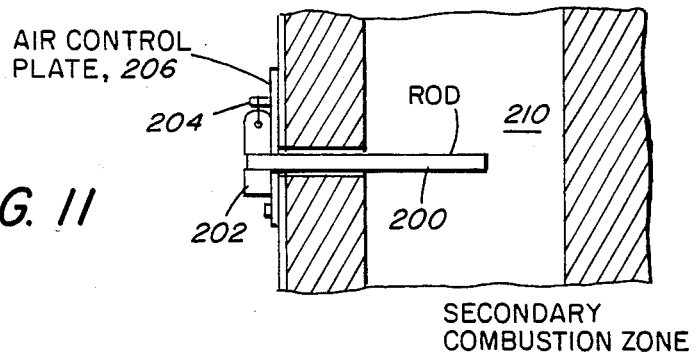
FIG. 11 is a side view of the assembled secondary air control device of FIG. 10 mounted in the wall of the secondary combuston chamber.

As shown in FIGS. 10 and 11, one embodiment of this device is comprised of a high temperature heat conducting rod 200, a bi-metallic thermostat coil 202, a wire connecting linkage 204 and a specially shaped air control plate 206 pivotally mounted at **206*a* over the secondary air inlet orifice 208**.

This device senses the temperature within the secondary combustion zone 210 (FIG. 11) and then regulates (or meters) the secondary air flow in such a way as to maximize the temperature within the secondary combusiton zone.

This is accomplished by the use of the high temperature heat conducting rod 200 inserted through the secondary combustion chamber wall 212 within the desired region within the secondary combustion zone 210. Rod 200 transfers heat to the externally mounted bi-metallic thermostat coil 202 in a manner proportional to the secondary combustion zone temperature. The bi-metallic coil 202 reacts to the rod temperature and causes motion of the connecting linkage 204 and finally the air control plate 206. The angular position of the air control plate over the secondary air inlet orifice determines the secondary air flow.

The shape of the air control plate 206, the shape of the secondary air inlet orifice 208, the length of the connecting linkage 204, the characteristics of the bi-metallic coil 202 and the length and location of rod 200 can be varied to obtain the desired control characteristics.

Figure 12:
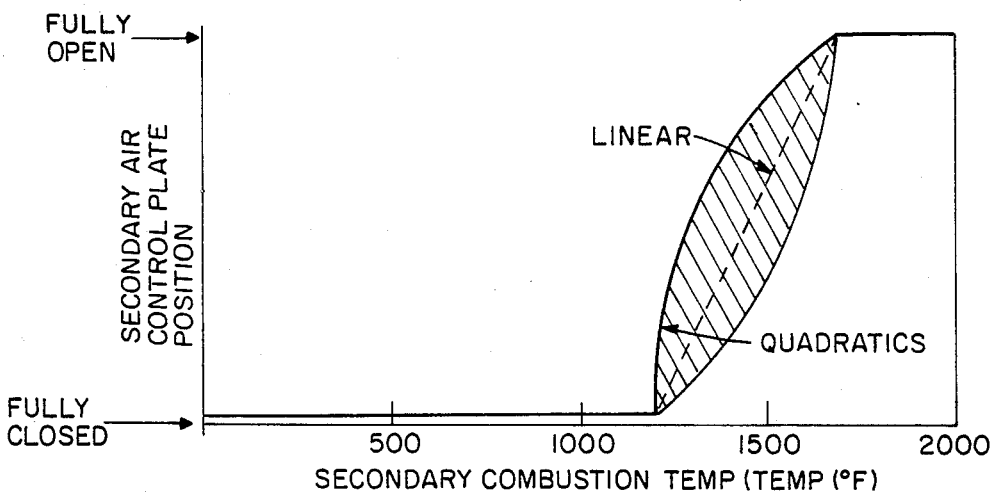
FIG. 12 is a graph relating secondary combustion zone temperature to the secondary air control plate position.

In the preferred embodiment, the secondary air orifice remains essentially closed until temperatures within the secondary combustion zone exceed 1200° F. Air is introduced as the rod senses increasing secondary zone temperatures and the air control orifice is essentially fully open when the secondary zone has reached 1700° F. The amount of air introduced once the control senses that air is required is in a relationship proportional to the secondary combustion zone temperature over the 1200°-1700° F. range. The proportionality may be a simple linear relationship or be a more complex geometric or quadratic relationship. FIG. 12 shows the envelope which represents the optimum range of secondary air versus secondary combustion zone temperature.

At temperatures less than 1200° F., the introduction of additional air to the secondary combustion zone is often a liability. The air can cause a "quenching" effect for two reasons. First, it can lower the temperature within the secondary zone and secondly it can dilute the combustible gas mixture. Both of these effects will decrease the probability of ignition of the combustibles within the secondary zone.

The rate at which secondary air should be introduced in the 1200° F.–1700° F. range depends in part on the design of the secondary combustion system. A simple linear relationship between air flow and secondary temperature may be adequate for one design while a more complex relationship may give better results for a different combustion system. Variations on the illustrated design provide a variety of air control relationships.

It is thus seen that the objects of this invention have been achieved in that there has been disclosed solid fuel heating apparatus capable of high thermal efficiency and low levels of polluting emissions. The heating appliance as disclosed herein achieves these results by means of an insulated secondary combustion chamber where combustion is sustained after ignition by a catalytic igniter. Importantly, the combustible mixture entering the catalytic igniter is preheated in a regenerative fashion by means of heat from the final exhaust gases. As described above, this arrangement provides for sustained secondary combustion resulting in more heat being extracted from the solid fuel source and also resulting in cleaner waste products without adversely affecting primary combustion. In particular, the thin catalytic element utilizes the catalytic property in the most appropriate way, namely as an igniter, not a combustor. This feature enables the catalytic element to have a low profile reducing its undesirable flow restrictive properties. The unitary stove embodiment maintains control over primary combustion by isolating the final exhaust heat exchangers and by oxygen-depleting the primary exhaust so that primary and secondary combustion can be independently controlled.

It is recognized that modifications and variations of the above-described embodiment will occur to those skilled in the art without departing from scope or principles of the invention. For example, features of the retrofit embodiment can be employed in the unitary stove and vice versa. Moreover, while a catalytic-type element is preferred as the igniter means, other devices may be usefully employed in the entrance to the secondary combustion region to achieve essentially the same effect of lowering the required temperature of the incoming primary exhaust gases necessary to ultimately achieve ignition and combustion in the secondary combustion chamber. It is intended that all such modifications and variations be included within the scope of the appended claims.

What is claimed is:

1. A solid fuel burning heating stove with enhanced secondary combustion comprising:

a primary combustion chamber for burning a load of fuel contained therein with a primary outlet for primary exhaust laden with unburned volatiles;

an insulated secondary combustion chamber having an entrance followed by a combustion region where secondary combustion predominates and a final exhaust region of spent gases;

a passageway leading from said primary outlet to said entrance;

means for admitting secondary air to said passageway and for producing a mixture of secondary air and primary exhaust before said entrance;

igniter means spanning said entrance for encouraging ignition of said secondary air/primary exhaust mixture by lowering the temperature of the mixture required to achieve ignition;

means for admitting additional secondary air to said secondary combustion region after said igniter means; and regenerative feedback means in heat exchange relationship with said final exhaust for preheating said mixture before encountering said igniter means using the sensible heat of said spent gases;

whereby secondary combustion is sustanied by the availability of the igniter means to overcome fluctuations in the temperature and composition of the primary exhaust which might otherwise foil ignition, and by using the heat of spent gases rather than primary combustion to maintain the temperature of the mixture entering the secondary combustion chamber at an elevated level.

2. The apparatus of claim 1, wherein said regenerative feedback means is formed by a common wall between said final exhaust region and said passageway acting as a heat exchanger.

3. The apparatus of claim 2, wherein said common wall is made of thermally conductive material.

4. The apparatus of claim 2, wherein said common wall is stainless steel.

5. The apparatus of claim 2, wherein said common wall has a convoluted configuration to present a large surface area to promote heat transfer.

6. The apparatus of claim 1, wherein said regenerative feedback means includes means for preheating the secondary air admitted to said passageway with the heat of said spent gases to thereby preheat said mixture.

7. The apparatus of claim 6, further comprising means for preheating the secondary air admitted to said secondary combustion region with the heat of said spent gases.

8. The apparatus of claim 1, further comprising heat exchanger means communicating with said secondary combustion chamber separated from said primary combustion chamber by a room air space for transferring the heat of the spent gases to the room air, whereby heat transfer to room air is accomplished without interfering with primary combustion.

9. The apparatus of claim 1 wherein said primary combustion chamber includes means for supporting a bed of coals, and means for forcing the primary exhaust through said bed of coals just before exiting to said passageway to enhance oxygen depletion of said primary exhaust to maintain a consistent level of oxygen in said mixture.

10. The apparatus of claim 9 wherein said means for admitting additional secondary air includes secondary air control means for controlling the amount of secondary air added to said secondary combustion region as a function of temperature inside said region such that the secondary air volume is adjusted from a minimum to a maximum level over a predetermined temperature range.

11. The apparatus of claim 10 wherein said minimum level has no additional secondary air.

12. The apparatus of claim 10 wherein said range is from about 1300° F. to about 1700° F.

13. The apparatus of claim 1 wherein said igniter means is a catalytic igniter.

14. The apparatus of claim 13 wherein said catalytic igniter has a thickness and perforate open area to reduce the pressure drop across the igniter for improved draft.

15. The apparatus of claim 13 wherein said catalytic igniter includes a ceramic substrate coated with a catalyst.

16. The apparatus of claim 13 wherein said catalytic igniter includes a metal substrate coated with a catalyst.

17. The apparatus of claim 1 wherein said secondary combustion chamber is insulated with refractory material.

18. The apparatus of claim 1 wherein said regenerative feedback means comprises secondary combustion air manifolds in heat exchange relation with said final exhaust.

19. The apparatus of claim 1 wherein said stove includes side heat exchangers separated from the primary and secondary combustion chambers by convective air spaces for enhanced heat transfer into a room to be heated.

20. The apparatus of claim 19 wherein said side heat exchangers include circuitous pathways to enhance heat exchange surface area.

21. The apparatus of claim 1 wherein the entrance to said secondary combustion chamber includes a lower ramp portion for guiding combustion gases and for substantially preventing ash build-up in said secondary combustion chamber.

22. The apparatus of claim 1 wherein said secondary combustion chamber includes refractory baffles arranged to enhance mixing of the combustion gases and to re-radiate heat onto the catalytic igniter.

23. The apparatus of claim 1 wherein said secondary combustion chamber is lined with insulating material having an undulating surface to enhance mixing.

24. The apparatus of claim 1 wherein said secondary combustion chamber includes a heat transferring barrier creating first and second passageways, the first passageway adapted for conveying primary exhaust through said catalytic igniter whereby secondary combustion heat in said second passageway is transferred to the exhaust gases in the first passageway through the heat transfer barrier.

25. The apparatus of claim 1 wherein said means for admitting additional secondary air includes secondary air control means for controlling the amount of secondary air added to said secondary combustion region as a function of temperature inside said region such that the secondary air volume is adjusted from a minimum to a maximum level over a predetermined temperature range.

26. The apparatus of claim 25 wherein said minimum level has no additional secondary air.

27. The apparatus of claim 25 wherein said range is from about 1300° F. to about 1700° F.

28. A solid fuel burning heating stove with enhanced secondary combustion, comprising:

a primary combustion chamber for burning a load of fuel contained therein with a primary outlet for primary exhaust laden with unburned volatiles;

a refractory lined secondary combustion chamber having as entrance followed by a combustion region where secondary combustion predominates in a final exhaust region of spent gases;

a passageway leading from said primary outlet to said entrance;

means for admitting secondary air to said passageway and for producing a mixture of secondary air and primary exhaust before said entrance;

catalytic igniter means spanning said entrance for encouraging ignition of said secondary air/primary exhaust mixture by lowering the ignition temperature of the mixture;

means for admitting additional secondary air to said secondary combustion region after said igniter means; and regenerative feedback means in heat exchange relationship with said final exhaust for preheating said mixture before encountering said catalytic igniter using the sensible heat of said spent gases, whereby secondary combustion is sustained by the availability of the igniter means to overcome fluctuations in the temperature and composition of the primary exhaust which might otherwise foil ignition, and by using the heat of spent gases rather than primary combustion to maintain the temperature of the mixture entering the secondary combustion chamber at an elevated level.

29. The apparatus of claim 28 wherein said primary outlet for primary exhaust is located to force the primary exhaust through a charcoal bed within the stove resulting from primary combustion to heat the primary exhaust and to substantially deplete the primary exhaust of oxygen.

* * * * *